313-422
10/26/82 OR 4,356,427 SR

United States Patent [19]

Noguchi et al.

[11] 4,356,427

[45] Oct. 26, 1982

[54] FLAT DISPLAY DEVICE

[75] Inventors: Mikio Noguchi, Chigasaki; Kazuho Kobayashi, Yokohama, both of Japan

[73] Assignee: Tokyo Shibaura Denki Kabushiki Kaisha, Kawasaki, Japan

[21] Appl. No.: 178,283

[22] Filed: Aug. 15, 1980

[30] Foreign Application Priority Data

Aug. 16, 1979 [JP] Japan ..... 54/103576
Jun. 13, 1980 [JP] Japan ..... 55/78915

[51] Int. Cl.[3] ..... H01J 29/50
[52] U.S. Cl. ..... 313/422; 315/169.3
[58] Field of Search ..... 313/409, 422, 410

[56] References Cited

U.S. PATENT DOCUMENTS 3,408,532 10/1968 Hultberg et al. ..... 313/105 CM X
3,432,710 3/1969 Gumpertz ..... 313/410
3,935,500 1/1976 Oess et al. ..... 313/495

OTHER PUBLICATIONS

Gunther et al., "A Flat Alphanumeric Display Tube," IEEE Transactions on Electron Devices, vol. ED-18, #9, Sep. 1971, pp. 692-697.

*Primary Examiner*—Robert Segal
*Attorney, Agent, or Firm*—Cushman, Darby & Cushman

[57] ABSTRACT

Within a vacuum envelope constituted by a back base plate and a display panel, a thermionic cathode structure and first to third electrode structures are arranged in the mentioned order from the side of the back base plate to the side of the display panel. In the thermionic cathode structure a plurality of coiled heaters are arranged in a planar array such that each coiled heater corresponds in position to each of picture element regions regularly arranged in a fluorescent material layer provided on the inner side of the display panel. The coiled heaters are supported such that their effective thermionic electron emitting portions are held in space such that each of these portions corresponds to each of the picture elements, and their other portions are supported by a plurality of support members. These support members are arranged such that all the coiled heaters are connected in parallel to a heating power supply.

4 Claims, 13 Drawing Figures

FLAT DISPLAY DEVICE

This invention relates to flat display devices and, more particularly, to a flat display device having a thermionic cathode structure including a plurality of thermionic cathodes arranged in a planar array as an electron beam source.

Cathode-ray tubes have hitherto been chiefly used for the display of television pictures and also the display of characters and drawings. This is because of the facts that they are superior in brightness, can quickly respond to signals, are capable of ready scanning for the display and are superior in the resolution of the displayed picture. However, they have drawbacks in that the depth of the device is large compared to the image display area and that the life of the device is comparatively short.

As receiving tubes were replaced by semiconductor devices, researches and investigations have been made to replace the display devices using semiconductor elements with cathode-ray tubes. As flat display devices, liquid crystals, electroluminescence phenomenon or plasma discharge display have been developed. Any of these display devices, however, is inferior in the luminescent efficiency and the speed of response to a cathode-ray tube. Meanwhile, with a trend for the density increase of the information handled by electronic computers there have been increasing demands for improved performance of the display device for displaying such information and also for increased display area of the display device.

A flat display device, in which an electron beam emitted in vacuum from a flat electron emitting structure is controlled by a combination of voltages supplied to a plurality of flat electrode structures each having a number of electron beam passage holes and then the electrons are accelerated by an accelerating voltage supplied to the following stage for causing fluorescence of a desired picture element region (or merely referred to as picture element) on a fluorescent screen, is disclosed in, for instance, U.S. Pat. Nos. 3,408,532 and 3,935,500. In the device disclosed in the U.S. Pat. No. 3,408,532 has a cold cathode electrode excited by a radiant ray or photoelectric effect, and electrons emitted from the cold cathode is amplified through a secondary electron multiplier for obtaining a desired electron beam. The reason for adopting this cold cathode which has unknown technical problems as the electron emitting source is to avoid the temperature rise of the display device due to power consumption. However, since the use of cold cathodes and the secondary electron multiplication is required, the realization of a practically feasible flat display device is difficult. The display device disclosed in the aforementioned U.S. Pat. No. 3,935,500 has a flat thermionic cathode structure. In this device, predetermined portions of a tungsten wire heater project in the form of hair pins, and the cathode is formed in these projected portions. However, since the cathodes are connected in series, the voltage difference between the heater terminals are high, so that a shading pattern is liable to result. In addition, thermal energy of the heater flows through a base plate, so that the conduction loss of energy is high. From this ground, it is difficult to obtain a flat display device having a large area. Further, a deflecting electrode is provided for hair-pin-like point thermionic cathodes for scanning a predetermined area of the fluorescent screen.

"IEEE Transactions on Electron Device", Vol. ED-18, No. 9, September 1971, pages 692 to 697, discloses a flat display device having a linear thermionic cathode. In this device, the fluorescence of a number of picture elements is caused by one thermionic cathode, and the voltage difference between the heater terminals is again high.

While the thermionic cathode adopted as electron beam source permits to obtain excellent brightness and high response speed of display and simple scanning, when constructing a flat display device various problems are involved in the construction of the thermionic cathode. More particularly, where the fluorescence of a plurality of picture elements is caused by one thermionic cathode as in the prior art device, there are problems in the reliability, power consumption and method of driving of the display device as described hereinbelow.

In the first place, the reliability of the display device will be discussed. The display device having a thermionic cathode has the problems of the reduction of the electron emission of the thermionic cathode and the burn-out of the heater. The occurrence of the burn-out of the heater is determined by the probability of occurrence of incidental accidents. In the structure where the fluorescence of a plurality of picture elements is caused by one thermionic cathode, the burn-out of one thermionic cathode leads to an accident of the display device.

Now, the power consumption of the display device will be discussed. In this type of the display device, the power consumption of the heater constituting the thermionic cathode is an important factor, and the heat generation in the display device due to power consumption imposes restrictions upon the design of the display device. For causing the fluorescence of a plurality of picture elements with one thermionic cathode, even the portions of the heater that are found between adjacent picture elements also have to be heated as well as the portions corresponding to picture elements, so that abundant power is required for operating the heater.

In the third place, the method of driving of the display device will be discussed. Where the heater is long as mentioned above, the potential difference between the opposite heater terminals is high. While a modulation voltage based upon the potential on the cathode has to be supplied on the electrodes for controlling the electron beam emitted from a cathode where the aforementioned potential difference is high, it is sometimes necessary to correct the modulation voltage supplied on these electrodes, and otherwise various technical problems will arise. More particularly, the aforementioned correction is required where a voltage for controlling an electron beam emitted from a portion of the heater near one end thereof and a voltage for controlling an electron beam emitted from a portion of the heater near the other end thereof are different from each other, and otherwise shading in the display will result. Further, in the structure where one thermionic cathode is provided for a plurality of picture elements, a means for deflecting the electron beam is necessary and which means leads to additional complexity of construction of the display device.

An object of the invention, accordingly, is to provide a flat display device, which comprises a thermionic cathode structure including a plurality of thermionic cathode heaters individually corresponding to respective picture element regions provided in a predetermined array on a fluorescent material layer provided on the inner side of a flat display panel, these thermionic cathode heaters being connected in parallel to a single heating power source.

The flat display device according to the invention comprises a vacuum envelope constituted by a back base plate and a flat display panel provided with an inner fluorescent material layer, a thermionic cathode structure disposed on or near the inner side of the back base plate and extending parallel to the display panel, and a plurality of flat electrode structures stacked together with intervening insulators between the thermionic cathode structure and the fluorescent material layer and each having a plurality of thermionic electron beam passage holes, the plurality of flat electrode structures being arranged such as to control and accelerate thermionic electron beam emitted from the thermionic cathode structure so as to cause the thermionic electron beams to impinge upon picture element regions predetermined in a regular arrangement on the surface of the fluorescent material layer, the thermionic cathode structure including a plurality of coiled heaters each having an effective thermionic electron emitting portion constituted by a coating of a thermionic electron emitting material, each of the thermionic electron emitting portions being provided for each of the picture element regions, the thermionic electron passage holes in the flat electrode structures being each provided at a position corresponding to each of the effective thermionic electron emitting portions, the coiled heaters being supported in their predetermined portions other than the effective thermionic electron emitting portions by a plurality of support members such as to hold the effective thermionic electron emitting portions in space, the support members being arranged such as to connect the coiled heaters in parallel to a heating power source.

According to the invention effective thermionic electron emitting portions of coiled heaters each correspond to each of picture elements, so that unlike the case where one cathode corresponds to a plurality of picture elements there is no need of deflecting electron beams, and it is necessary to control only the brightness. Also, even if some heaters are burnt out or in open states initially, no fatal fault of the display device results unless a plurality of burn-outs of successive portions take place. Thus, it is possible to improve the reliability of the display device. Further, since the coiled heaters are connected in parallel, the potential difference between the opposite terminals of every heater is low, so that no correction of the voltage for controlling the thermionic electron beam current on the basis of the potential difference between the opposite terminals of the coiled heater is necessary. Still further, it is possible to prevent deviations of the thermionic electron emitting portions from their regular positions to face respective picture elements due to the elongation of the heaters.

This invention can be more fully understood from the following detailed description when taken in conjunction with the accompanying drawings, in which.

Figure 1:
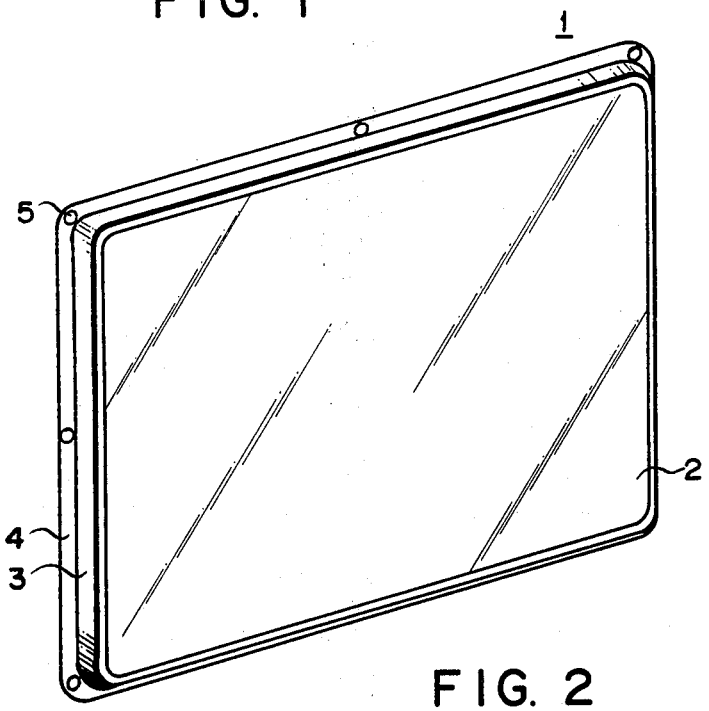
FIG. 1 is a perspective view showing a display device according to the invention.
Figure 2:
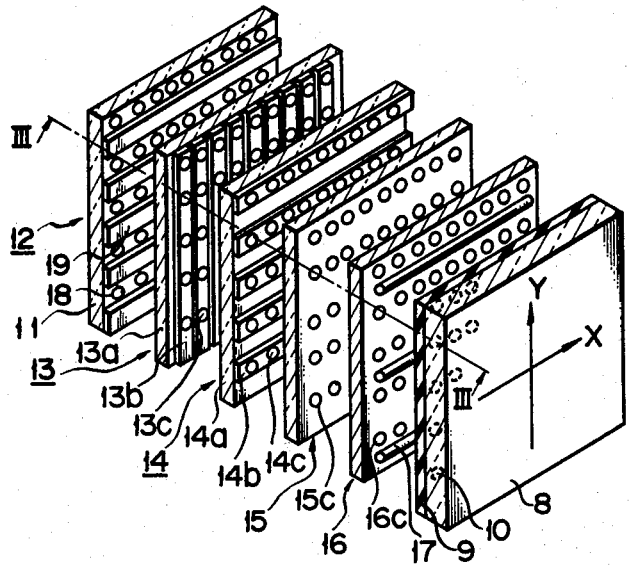
FIG. 2 is a fragmentary exploded perspective view showing the inner construction of the device shown in FIG. 1, with a thermionic cathode structure, control electrode structures and a display panel being shown separated from one another.

Now, an embodiment of the invention will be described with reference to the accompanying drawings. FIG. 1 shows a perspective view of a flat display device 1 embodying the invention, with control devices (not shown) being connected to the outside of its vacuum envelope. Its display panel is provided with an outer protective plate 2 which is a transparent plastic plate or a glass plate. The protective plate 2 is provided around its edges with a support frame 3 and a flange 4. The flange is formed with holes 5 for mounting the display device. FIG. 2 shows the internal construction of the display device shown in FIG. 1. Referring to FIG. 2, the display panel, designated at 8, for instance consisting of transparent glass, is provided with an inner fluorescent material layer 9. The fluorescent material layer 9 contains portions 10 used as picture element regions (hereinafter referred to as picture elements). These picture elements 10 are arranged in a matrix form. X and Y directions are shown on the display panel 8 for the sake of the convenience of the description. A back base plate 11, for instance made of glass, is provided to face the display panel 8. The edges of the back base plate 11 and display panel 8 are sealed with a well-known means to form a vacuum envelope. The back base plate 11 is provided with a flat thermionic cathode structure 12. A first electrode structure 13, a second electrode structure 14, an insulating support 15 and a third electrode structure 16 are arranged in the mentioned order between the thermionic cathode structure 12 and fluorescent material layer 9 as is shown. Between the third electrode structure 16 and fluorescent substance layer 9 a plurality of insulating spacers 17 are provided to extend in the X direction. While the thermionic cathode structure 12, first electrode structure 13, second electrode structure 14, an insulating support 15 and third electrode structure are shown spaced apart from one another, they are actually held in contact with one another and urged against the fluorescent material layer 9 via the spacers 17 (see FIG. 3).

Figure 3:
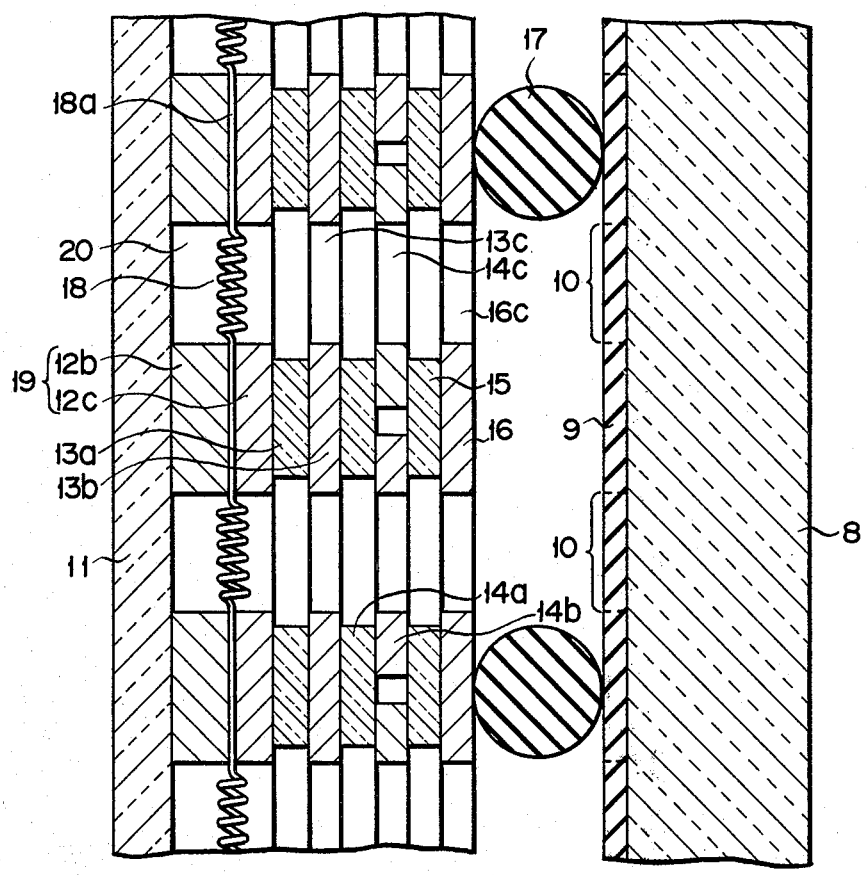
FIG. 3 is an enlarged-scale fragmentary sectional view of the device taken along a line corresponding to a plane along line III—III in FIG. 2 and extending parallel to Y direction.
Figure 4:
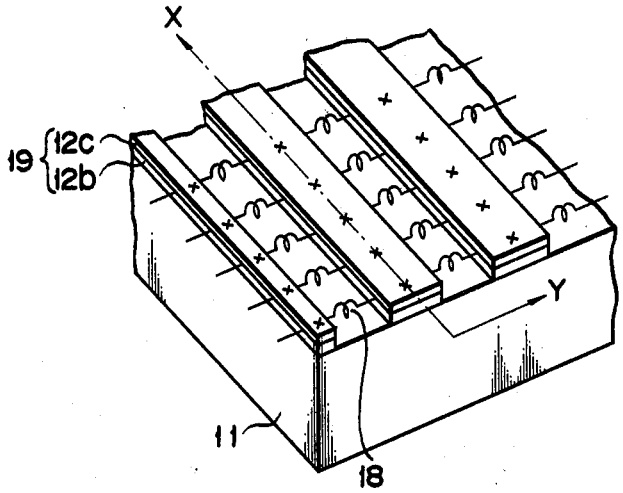
FIG. 4 is an enlarged-scale fragmentary perspective view showing the thermionic cathode structure shown in FIG. 2.
Figure 6:
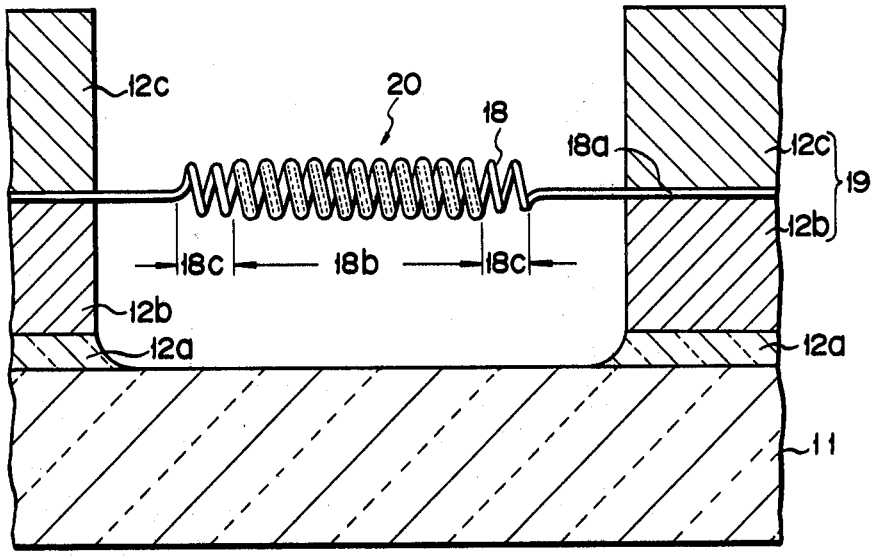
FIG. 6 is an enlarged-scale fragmentary sectional view showing the relation between a coiled heater in the thermionic cathode structure shown in FIG. 1 and support members supporting the coil heater.

As shown in FIGS. 4 and 6, the thermionic cathode structure 12 includes first support members 12*b* each bonded by an adhesive layer 12*a*, for instance consisting of frit glass, to the back base plate 11, second support members 12*c* each provided over each of the first support members 12*b* and coiled heaters 18. According to the invention, at least either the first or second support members 12*b* and 12*c* may be conductive, but in the instant embodiment both of these support members are conductive. In FIGS. 2 and 3, the first and second support members 12*b* and 12*c* are generally designated by reference numeral 19. These support members 19 serve to support predetermined portions 18*a* of the individual coiled heaters 18 in the conductive relation thereto and supply power to the heaters 18 for heating them. In FIG. 2, the support members 19 extend in the X direction, and the individual coiled heaters 18 are each supported in each specific space 20 (as shown in FIG. 6). The coiled heaters are coated with a thermionic electron emitting substance to be described later, and the portion of the heater on which the thermionic electron emitting substance is coated is designated by reference symbol 18*b*. The individual coiled heaters 18 are provided for the respective picture elements 10, and they are all connected in parallel to one another to a heating power source (not shown) through the support members 19.

The first electrode structure 13 includes a plurality of first electrodes 13*b* secured to an insulating plate 13*a* of glass or the like and extending in the Y direction. These first electrodes 13*b* are each provided with thermionic electron beam passage holes 13*c*. Of course, the insulating plate 13*a* is formed with holes corresponding to the holes 13*c*. The second electrode structure 14 includes an insulating plate 14*a* and second electrodes 14*b* secured to the insulating plate 14*a* and extending in the X direction. The second electrodes 14*b* are each provided with thermionic electron beam passage holes 14*c* and the insulating plate 14*a* are provided with corresponding holes 14*c*. The insulating support 15 is provided with thermionic electron beam passage holes 15*c*. The third electrode structure 16 consists of a single metal plate formed with thermionic electron beam passage holes 16*c*. The spacers 17 are secured to the third electrode structure 16. FIG. 3 is a fragmentary sectional view taken along line III—III in FIG. 2 and viewed in the Y direction. The Figure shows the positional relation among the thermionic cathode structure 12, first and second electrode structures 13 and 14, insulating support 15, third electrode 16 and fluorescent substance layer 9. As is apparent from FIG. 3, the coiled heaters 18 are each provided to correspond to each of picture element regions (picture elements) 10 provided in the fluorescent substance layer 9, and also the thermionic electron beam passage holes 13*c*, 14*c* and 16*c* in the first, second and third electrode structures 13, 14 and 16 are each provided to correspond to each of the picture elements. A metal back layer (not shown) may, if necessary, be provided on the fluorescent substance layer 9. As mentioned eariler, a vacuum evelope is formed with the display panel 8 and back plage 11. Conductors for supplying power to the coiled heaters 18, conductors for supplying signals on the first and second electrode structures and conductors for supplying voltage on the third electrode structure and back metal layer are all led to the outside of the vacuum envelope, but they are not shown. While in the instant embodiment the thermionic cathode structure 12 is secured to the back plate 11, it is also possible to provide the thermionic cathode structure with separation from the back plate.

Figure 5:
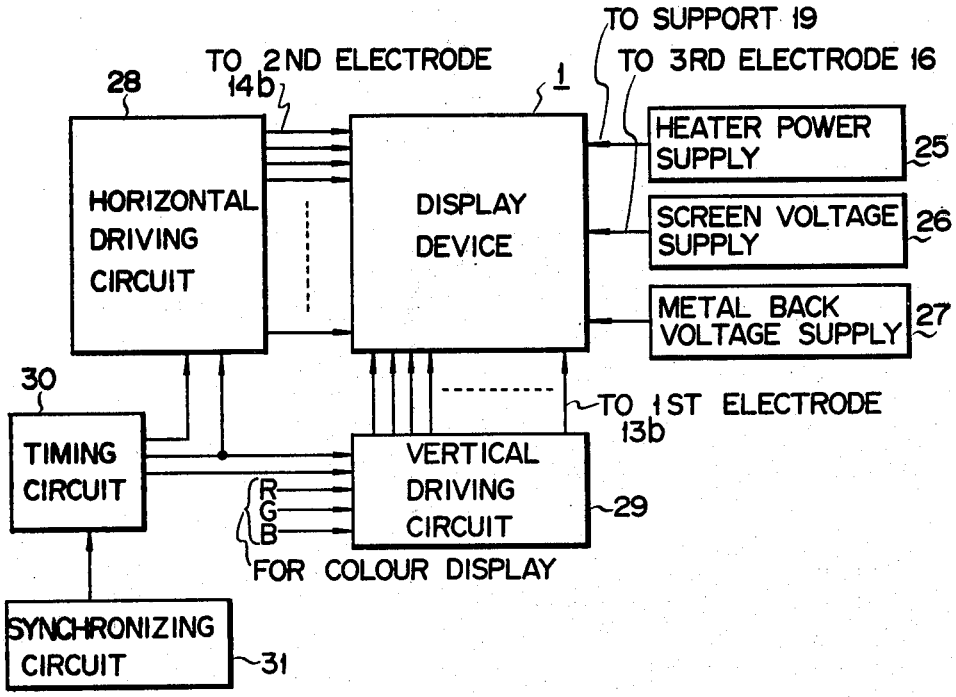
FIG. 5 is a block diagram showing the state of connection of external control circuits to the device shown in FIG. 1.

FIG. 5 shows external circuits connected to the display device 1. A heater power supply 25 supplies power to the conductive support members 19. The terminal voltage across the coiled heaters 18 is about 0.5 V. To the third electrode 16 about 100 V is supplied as screen voltage from a screen voltage supply 26. To the metal back layer (not shown) a voltage of about 5 kV is supplied, if necessary, from a metal back layer voltage supply. A signal for selecting a picture element in the horizontal direction (X direction driving signal) is supplied from a horizontal driving circuit 28 to the second electrode 14*b*, and a signal for selecting a picture element in the vertical direction (Y direction driving signal) is supplied from a vertical driving circuit 29 to the first electrode 13*b*. To the circuits 28 and 29 are supplied timing signals from a timing circuit 30, which is controlled by a synchronizing circuit 31.

The operation and effects of the flat display device of the above construction will now be briefly described. In the first place, the reliability of the device, which is a primary feature thereof, will now be considered. Since each coiled heater 18 corresponds to each picture element 10 as shown in FIG. 3, the emission of very little quantity of thermionic electrons from the effective thermionic electron emitting portion 18*b* (FIG. 6) is sufficient. For this reason, the temperature of the thermionic cathode can be reduced to the lowest temperature (or threshold temperature) required for the thermionic electron emission. Further, since the operation failure of the thermionic cathode, for instance the burn-out of the coiled heater 18, affects only the corresponding element, the probability of the faulty display in extremely reduced. (This reliability problem will be discussed hereinafter.) Now, low power consumption, which is the second feature of the device, will be discussed. Since very low thermionic electron beam is required for one thermionic cathode as mentioned earlier, the area of one thermionic cathode can be extremely reduced. Since the operating temperature of the thermionic cathode can be reduced to the threshold temperature as mentioned earlier, and also since the coiled heaters 18 can each be held in a specified space, it is possible to reduce the power consumption of one thermionic cathode to be lower than 1 mW. This order of power consumption, namely 1 mW, is practically a threshold value which could not have been realized. This will be discussed hereinafter in further detail. The third feature of the display device is that its drive circuit is extremely simplified. More particularly, since each coil heater 18 corresponds to each picture element 10, the deflection of the electron beam is unnecessary, and it is necessary only to adjust the brightness. Further, it is possible to set the terminal voltage across every coiled heater 18 to, for instance, 0.5 V, that is, it is possible to set the voltage on one terminal of every coiled heater to 0.5 V when the voltage on the other terminal is set to 0 V. This means that where the voltages to be applied to the first and second electrodes for modulating the thermionic electron beam are set to, for instance, 10 V, there is no need of correcting these modulating voltages according to the potential difference between the opposite terminals of the coiled heater.

RELIABILITY

The aforementioned improvement of the reliability of the display device will now be described in detail. In the display system using a thermionic cathode, the reduction of the thermionic electron emission capability of the thermionic cathode and burn-out of the heaters are inevitable. These phenomena are collectively called fatigue phenomenon of the cathode. This fatigue phenomenon is attributable to the evaporation of the metal constituting the heater and the oxide of this metal. It is increased as a "power" of the operating temperature of the cathode. According to the invention, the thermionic cathode can be operated at a low temperature practically equal to the threshold temperature as mentioned earlier, so that the fatigue phenomenon can obviously be reduced. For example, with a flat display device of 1,000 mm×750 mm and designed as a system for driving one line at a time even by restricting the thermionic electron beam from one cathode to 30 μA an image of a brightness corresponding to that of the image of a shadow-mask type color television set can be obtained. Where the thermionic electron beam is as low as mentioned above, the temperature of the heater constituting the thermionic cathode (direct heating type) may be about 800° C. On the other hand, the heating temperature of the thermionic cathode heater used in the ordinary thermionic electron emission tube is above 1,000° C. as it is ordinary indirect heating type. This is the utmost reason, for which a long life of the thermionic cathode can be obtained.

It is known that the wear phenomenon mentioned earlier is related to incidental accidents before the occurrence of the fatigue phenomenon. The incidental accidents are caused from inevitable variations at manufacturing processes. If 0.01% of the heaters burn out in ten thousands hours due to the aforementioned accidents, with a flat display device having 750 KP (KP=1,000) picture elements 75 heaters are forecast to be burnt out in ten thousands hours. With a display device having such a screen area it is usual to observe the picture from a position at a distance of about 3 m from the device. In this case, defects with diameters above 3.00 mm are recognizable, when a moving picture is observed defects with diameters above 5 mm are felt obstructive in effect. Such a defect occurs in case when two or three heaters located in successive positions are burnt out. In other words, even if 75 heaters are burnt out, these burn-outs can be practically ignored so long as they are randomly scattered over the screen, but with two or three burnt-out heaters located in successive positions the display device is regarded to be defective. The probability that two heaters located in successive positions are burnt out is 0.075%, and the probability that three heaters located in successive positions are burnt out is 0.000075%.

The fact that this probability of 0.075% or 0.000075% is very low compared to that of the prior-art flat display device will become apparent from the following. Considering a display device, in which one thermionic cathode heater corresponds to 30 picture elements, the number of heaters in it is 25 KP if the number of picture elements is 750 KP. Assuming that the probability of occurrence of burn-outs of heaters is the same as that of the aforementioned display device having 750 KP picture elements according to the invention, 25 KP×0.01%=2.5 heaters are burnt out in ten thousands hours. In this case, with the burn-out one heater a defect including 30 picture elements successively arranged is produced on the screen. This defect is felt obstructive in practice, and with at least 2.5 such defects on the screen the display device can no longer withstand use.

LOW POWER CONSUMPTION

Now, the second feature of the invention, i.e., low power consumption, will be described. As mentioned earlier, with the display device according to the invention, in which the cathodes are provided each for each of the picture elements, the electron beam from one cathode can be set to about 30 μA. Since according to the invention the electron beam from one cathode is neither scanned nor shifted in position, the electron beam in the electric field for modulating it is stabilized in position. Where the thermionic electron emission is about 30 μA, the area of the thermionic cathode can be set to about $10^{-5}$ cm$^2$. The operating temperature of the thermionic cathode is about 800° C., so that where the power density on the surface of the coiled heater is 4 W/cm$^2$, the power consumption P of the heating portion of the coil heater is $P=4\times10^{-5}$ W. The power consumption $P=4\times10^{-5}$ W represents only the power consumption of the heating portion as the cathode, and besides this power consumption power is also consumed in the current supply path to the heating portion and through the heat conduction through the heater support which is at a low temperature. Accordingly, a construction in which the power consumption in the current path and the heat conduction loss in the heater support are both low, is required. According to the invention, the coiled heater 18 is held in the space 20 to reduce the heat conduction through the support (i.e., conductive members) 19. Also, the predetermined portion 18*a* (FIG. 6) of the coiled heater 18 is supported with the support 19 of a low resistivity to make low the power consumption in the current path. Thus, it is possible to set the power consumption of one coiled heater to 0.4 to 0.8 mW, that is, even with a picture element number of 750 KP the total power consumption in the thermionic cathode structure 12 can be set to 300 to 600 W. This power consumption value is satisfactory for the actual device. Where the power consumption in the heating portion is $4\times10^{-5}$ W and the power consumption per coil heater is 0.4 mW$=4\times10^{-4}$ W, the ratio of the power consumption in the heating portion to that in heater is 10%, and this value is satisfactory in practice.

The coiled heater 18 will now be described in connection with its design examples. For the heater 18 a wire having a very small diameter of a low thermal conductivity is used. As the material of the coiled heater, tungsten, tungsten alloys and nickel-tungsten (Ni-W) alloys are desirable. Table below shows a design example of the coiled heater using a Ni-W alloy and with a total power consumption of 0.6 mW.

TABLE

| Parameter | Contents |
|---|---|
| Metal wire diameter | 2.6 μm |
| Material | Ni—W alloy |
| Outer diameter of coil | 20 μm |
| Length of coil | 0.3 mm |
| Extended length of coil | 2.5 mm |
| Electrical resistance of coil when heated | 470 Ω |
| Oxide coated surface area | $5\times10^{-5}$ cm$^2$ |

With the display device with a display panel diagonal length of 1.2 m the power consumption of the hot cathode structure 12 is desirably 500 W or below. If the power consumption is above 500 W, an undesirably high temperature of the electrode structure within the vacuum envelope results. If the number of coil heaters is 750 KP, the power consumption per heater is 500/750 KP=0.67 mW. A heater of 0.6 mW can be constructed by using a Ni-W alloy wire. Generally, a high quality and high density image can be obtained by increasing the number of picture elements. For instance, considering a display device which has 4,000 KP picture elements and in which the power consumption of the thermionic cathode structure is 500 W, the power consumption per heater is 0.125 mW≈0.1 mW, with the surface power density of the heater set to 4 W/cm$^2$, the thermionic electron beam from the thermionic electron emitting portion set to 6 μA and the power consumption in the heating portion of the heater to 0.01 mW, the ratio of the power consumption in the heating section of 0.01 mW to the power consumption per heater of 0.1 mW (heating portion power ratio) is 10%.

With a display device with a diagonal length of 1.2 m the power consumption is preferably less than 500 W, and with a picture element number of 250 KP the power consumption per heater is 500 W/250 KP=2 mW. However, in the display device of the above size the power consumption may be set to 750 W in some cases. With the power consumption of 750 W and the picture element number of 250 KP, the power consumption per heater is 750 W/250 KP=3 mW. In this way, the power consumption and picture element number are determined in dependence upon the use of the display device. From the considerations of the aforementioned power consumption and picture element number, it is concluded that the power consumption for a coiled heater is within the range of 0.1 to 3 mW and that the diameter of the metal wire constituting the heater is 0.3 to 5 μm.

SIMPLE DRIVING

The higher the heating voltage of the thermionic cathode, the problem of the interference between this voltage and the drive voltage of the display device is more serious. For the driving of the display device high density IC circuits including memories or shift registers are used. The voltage for driving the IC circuits is lower than 16 V. With the device according to the invention, in which all the coil heaters are connected in parallel with one another, the heating voltage supplied to the heater is about 0.5 V. Since the terminal voltage across the heater is about 0.5 V which is an ignorable value compared to the IC circuit driving voltage, and also since the heaters are uniformly distributed over the entire screen each heater for each picture element, there is no need of correcting the driving voltage according to the position of the picture element. Thus, the driving of the display device can be simplified.

FEATURES OF COILED HEATER

Now, it is supposed that linear heaters (each provided with a thermion emitting element) are provided each for each picture element, with the thermion-emitting portion of each heater held in a space and other portion of the heater secured to the support. With this structure, it is necessary to provide a predetermined tension to the heater itself for preventing the displacement of the effective thermionic electron emitting portion due to the elongation of the heater resulting from the thermal expansion and externally caused vibrations of the heater. This means that the heater must have a diameter of 5 μm to provide for its mechanical strength. In this case, at least 3 mW of power is required for one heater. Such a heater construction is not suited for the display device, in which one heater is provided for one picture element.

Figure 7A:
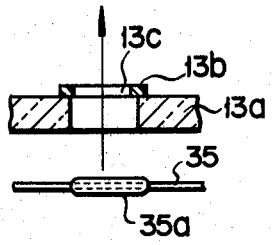
FIGS. 7A and 7B are views respectively showing the positional relation between a thermionic electron emitting portion of a linear heater and a first grid and the area of the picture element excited by the electron beam from the thermionic electron emitting portion.
Figure 8A:
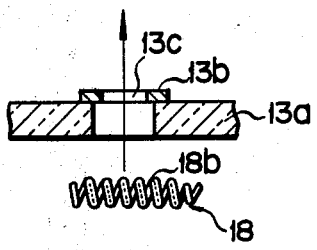
FIGS. 8A and 8B are views respectively showing the positional relation between a thermionic electron emitting poertion of a coiled heater according to the invention and a first grid and the area of the picture element excited by the thermionic electron beam from the thermionic electron emitting portion.
Figure 7B:
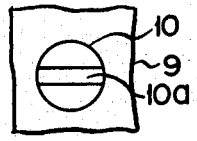
Figure 8B:
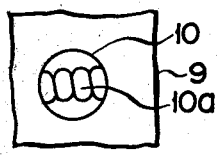

While the construction of the heater 18 according to the invention and the state of support of the heater have been briefly described with reference to FIG. 6, further details will now be given in this connection. In FIG. 6, designated at **12*b* is a KOVAR ribbon, and at 12*c* is a KOVAR or stainless steel ribbon. Major portions of the linear portions of the heater 18 are welded between the members 12*b* and 12*c*. The coiled heater 18 is obtained from a wire of for instance, tungsten, tungsten alloys or nickel-tungsten alloys which are capable of withstanding thermal deformation and mechanical machining and suited as the thermionic cathode material. In the effective thermion-emitting portion 18*b* a (Ba, Sr, Ca) $CO_3$ coating layer is provided as the thermionic electron emitting substance. This coating material is decomposed and activated by heating in vacuum. Coil portions 18*c* adjacent to the effective thermionic electron emitting portion 18*b* provide a substantially low temperature when the coiled heater is energized for heating, and they constitute low temperature portions having elastic characteristics even at the time of heating. It is desirable to form the coil portion with adjacent turns thereof in close contact with each other and then secure the predetermined portions 18*a* with the coil portion held stretched to such an extent that the coil ptch is about three times the wire diameter. By so doing, variations of the position of the effective thermionic electron emitting portion 18*b* relative to the thermionic electron passage holes 13*c*, 14*c* and 16*c* of the electrode structures with thermal expansion of the heater can be reduced. Further advantages of the coiled heater will now be discussed with reference to FIGS. 7A and 7B and FIGS. 8A and 8B. FIG. 7A shows a case where an effective thermionic electron emitting portion 35*a* of a linear heater 35 faces a thermionic electron passage hole 13*c* in the first electrode 13*b*. FIG. 7*b* shows the cathode area 10*a* projected on a corresponding picture element 10 in this case. FIG. 8A shows the relation between the effective thermionic electron emitting portion 18*b* of the coiled heater 18 and the corresponding thermionic electron passage hole 13*c* in the first electrode 13*b*. FIG. 8*b* shows the cathode area 10*a* projected on a corresponding picture element 10** in this case. As in apparent from these Figures, the cathode area contributing to light emitting from a picture element is greater in the case of the coiled heater, and assuming that the power consumption is the same the brightness is greater in the case of the coiled heater.

Figure 9:
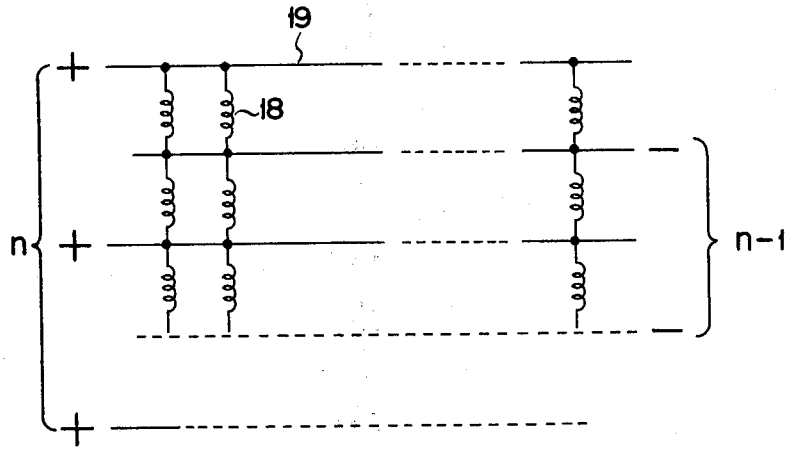
FIG. 9 is a view showing the connection between coiled heaters and support members and also the connection between the support members and a power supply.

FIG. 9 shows an example of the method of connection of the coiled heaters 18. As is shown, n plus terminals and (n−1) minus terminals are provided, and a plurality of heaters 18 are connected between the plus and minus terminals in each pair. In this way, all the heaters are connected in parallel between the plus and minus terminals. Where 500 picture elements are arranged in the Y direction, n is 251, and (n−1) is 250. In this case, 0.5 V is applied to one terminal of every heater 18.

Figure 10:
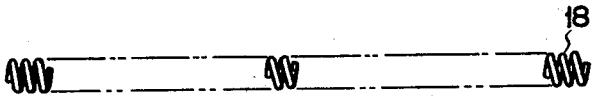
FIG. 10 is a plan view showing an example of the construction of coiled heaters.
Figure 11:
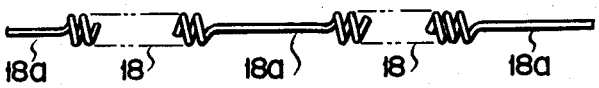
FIG. 11 is a plan view showing another example of the construction of coiled heaters.

FIG. 11 shows the shape of the coiled heater used in this embodiment. The coil 18 has a circular sectional profile. FIG. 10 shows a different example of the coiled heater. In this case, the successive heaters are provided as a continuous coil. When adopting the heaters of this shape, portions of the coil that are supported by the support members 19 may be deformed into a flat form. With the heater of this shape, the core on which the coil is wound is to be removed by means of etching. Thus, in this case the manufacture is simplified. The coil may have an elliptical sectional profile as well.

What we claim is:

1. A flat display device comprising:

a vacuum envelope constituted by a back base plate and a flat display panel provided with an inner fluorescent material layer;

a thermionic cathode structure disposed on or near the inner side of said back base plate and extending parallel to said display panel;

a plurality of flat electrode structures stacked together with intervening insulators between said thermionic cathode structure and said fluorescent material layer and each having a plurality of thermionic electron beam passage holes;

said plurality of flat electrode structures being arranged such as to control and accelerate thermionic electron beams emitted from said thermionic cathode structure so as to cause said thermionic electron beams to impinge upon picture element regions predetermined in a regular arrangement on the surface of said fluorescent material layer;

said thermionic cathode structure including a plurality of coiled heaters each having an effective thermionic electron emitting portion constituted by a coating of a thermionic electron emitting material, each of said thermionic electron emitting portion being provided for each of said picture element regions;

said thermionic electron passage holes in said flat electrode structures being each provided at a position corresponding to each of said effective thermionic electron emitting portions;

said coiled heaters being supported in their predetermined portions other than said effective thermionic electron emitting portions by a plurality of support members such as to hold said effective thermionic electron emitting portions in space; and said support members being arranged such as to connect said coiled heaters in parallel to a heating power source.

2. A flat display device according to claim 1, wherein the wire constituting each said coiled heater is made of a material selected from a group consisting of tungsten, tungsten alloys and nickel-tungsten alloys and has a diameter ranging from 0.3 to 5 $\mu$m.

3. A flat display device according to claim 1, wherein:

said plurality of flat electrode structures include first, second and third electrode structures arranged in the mentioned order from the side of said thermionic cathode structure to the side of said display panel, said first electrode structure having a plurality of first electrodes extending in either X or Y direction of said display panel, said thermionic electron passage holes being formed in said first electrodes;

said second electrode structure including a plurality of second electrodes extending parallel to said display panel and perpendicular to said first electrodes, said thermionic electron passage holes being formed in said second electrodes; and said third electrode structure consisting of a single electrode member having said thermionic electron passage holes.

4. A flat display device according to claim 3, wherein a signal for selecting picture elements predetermined in the X or Y direction of said display panel is supplied on said first electrode, a signal for selecting picture elements predetermined in the Y or X direction of said display panel is supplied on said second electrode, and a voltage for accelerating thermionic electrons emitted from a hot cathode corresponding to a selected picture element is supplied on said third electrode.

* * * * *